United States Patent [19]

Blanchette et al.

[11] 4,292,385

[45] Sep. 29, 1981

[54] BI-MODAL PHOTORECEPTOR AND METHOD

[75] Inventors: Robert G. Blanchette, Northfield; Denis J. Curtin, Chicago, both of Ill.

[73] Assignee: A. B. Dick Company, Chicago, Ill.

[21] Appl. No.: 72,450

[22] Filed: Sep. 4, 1979

[51] Int. Cl.[3] ..... G03G 13/044; G03G 5/04; G03G 5/10

[52] U.S. Cl. ..... 430/58; 430/57; 430/82

[58] Field of Search ..... 430/57, 58, 59, 66, 430/80, 31, 82

[56] References Cited

U.S. PATENT DOCUMENTS

| | | | |
|---|---|---|---|
| 3,037,861 | 6/1962 | Hoegl et al. | 430/80 |
| 3,840,368 | 10/1974 | Ikeda et al. | 430/66 |
| 3,915,076 | 10/1975 | Gotoda | 430/57 X |
| 4,088,483 | 5/1978 | Isono et al. | 430/66 |

*Primary Examiner*—Richard L. Schilling
*Assistant Examiner*—John L. Goodrow
*Attorney, Agent, or Firm*—McDougall, Hersh & Scott

[57] ABSTRACT

A photoreceptor for producing copy in a full form exposure mode and in a laser mode in which the charge generative layer is overcoated with an intermediate charge transport layer which is transparent to light and through which charges can transport and a top layer overcoating the intermediate layer which is transparent to white light and absorptive and charge generative to laser light.

8 Claims, 8 Drawing Figures

$V_{(+)} \ll V_o$ , NORMAL MODE FULL DISCHARGE $V_{(-)} \approx V_o$ , LOW DISCHARGE $V_{(-)} \ll V_o$ , NORMAL MODE FULL DISCHARGE $V_{(+)} \approx V_o$ , LOW DISCHARGE $V_{(-)} \ll V_o$ , FULL FRAME MODE FULL DISCHARGE $V_{(+)} \ll V_o$ , "LASER" MODE FULL DISCHARGE

NEGATIVE CORONA
FULL FORM EXPOSURE MODE

POSITIVE CORONA
LASER MODE

BI-MODAL PHOTORECEPTOR AND METHOD

FIELD OF THE INVENTION

This invention relates to the field of electrophotography and more particularly to an electrophotographic photoreceptor capable of being used bi-modally which means that the photoreceptor can be charged and light decayed using either polarity (negative or positive) of dark charge. This enables use of the same reuseable photoreceptor in the usual positive to positive copying of full form exposure or negative to positive copying of laser type exposure.

BACKGROUND OF THE INVENTION

The photoconductive insulating layer is imaged by first uniformly electrostatically charging its surface. The plate is then exposed to a pattern of activating electromagnetic radiation, such as light, which selectively dissipates the charge in the illuminated areas of the photoconductive insulator while leaving a latent electrostatic image in the non-exposed areas. This latent electrostatic image may then be developed to form a visible image by depositing finely divided electroscopic development particles onto the surface of the photoconductor.

The use of vitreous selenium, as described in Bixby U.S. Pat. No. 2,970,906, remains the most widely used photoreceptor in commercial reuseable xerography. Vitreous selenium is capable of holding and retaining an electrostatic charge over relatively long periods of time when not exposed to light, and is relatively sensitive to light as compared to most other photoconductive materials. In practice, vitreous selenium is usually given a positive surface charge during the electrical sensitizing operation. This positive charging takes advantage of the better hole conduction through the selenium layer during illumination, in that selenium has a much more efficient discharge for hole as compared to electrons.

In electrophotography, a photoconductive insulating layer is used which performs dual functions, namely charge generation and charge transport. In the most commonly used process, the functions are performed by a single layer, such for example as a layer of vitreous selenium.

In general, photoreceptor systems used in electrophotographic copying processes are required to exhibit both high dark resistivity for charge retention, and photoconductivity for charge dissipation in response to light activation. Photoconductivity occurs in response to light absorption generating charge carriers in the photoconductor which drift under the influence of the high field placed across the photoconductor in the dark. These charge carriers can be either electrons or holes, depending upon the intrinsic nature of the photoconductive layer. Rarely can a photoreceptor exhibit equal or nearly equal photoconduction through both carrier types. As a result, a photoreceptor layer cannot function equally well when charged negatively or positively.

This is illustrated in FIG. 1 of the drawings which represents the phenomenon occurring in the operation of a normal selenium photoreceptor having a thin layer of vitreous selenium on a conductive substrate. Selenium is a material which offers high mobility to positive charges or holes. In the normal mode, positive charges are established over the surface of the photoconductive selenium layer by corona discharge to charge the plate.

As shown in FIG. 1, upon exposure, photons emanating from the tungsten light in the exposed areas will create hole and electron pairs just below the selenium top surface.

The electrons created by the photons will discharge the positive charges on the surface while, on the other hand, holes move rapidly through the selenium layer to the grounded conductive backing. Thus a substantial surface voltage differential is established between the light struck areas and the non-light struck areas of the selenium photoreceptor to provide a latent electrostatic image capable of visual development.

On the other hand, if negative charges are distributed over the surface of the photoconductive selenium layer, as illustrated in FIG. 2, the holes created by the photons emanating in the light struck areas remain to neutralize the negative charges on the surface of the selenium photoconductor. The companion electrons do not transport through the selenium but instead remain trapped just under the surface and present a potential nearly identical to that of the above surface charges that were neutralized. Thus, the voltage differential between the light struck areas and the non-light struck areas is insufficient to define a latent electrostatic image capable of clear visual development.

Attempts have been made to produce a photoreceptor capable of being negatively charged and light decayed upon exposure to radiation. In U.S. Pat. No. 4,026,703, description is made of a dual layered photoreceptor employing vitreous selenium as a photosensitizing layer and a polymeric carbazole derivative as a charge retaining-charge transport layer overlying the selenium photosensitizing layer. In U.S. Pat. No. 3,861,913, description is made of a photoconductor formed of a selenium photosensitizing layer on a conductive substrate and a charge transport layer of tellerium, arsenic and selenium on the selenium photosensitizing layer.

FIG. 3 illustrates the assembly described in U.S. Pat. No. 4,026,703 wherein a top layer of organic photoconductive material, in the form of a polyvinyl carbazole, is provided on a thin layer of vitreous selenium which covers a conductive substrate 24.

In normal use, as illustrated in FIG. 3, the double layer photoreceptor is provided with an overall negative surface charge. The polyvinyl carbazole layer is transparent to white tungsten light such that the light can penetrate through to the underlying photoconductive selenium layer. This selenium layer acts as a charge generator so that the photons of light striking the selenium layer create the described hole and electron pairs. The contact surface between the selenium and the polyvinyl carbazole is designed so that the hole and the electron pairs can be injected across the interface. The holes transport through the polyvinyl carbazole layer to neutralize the negative charges in the corresponding areas on the top surface. The conductive backing is at a positive potential whereby the electrons are drawn thereto for discharge. This provides a substantial voltage differential between the light struck areas and the non-light struck areas to provide a latent electrostatic image capable of good visual development.

On the other hand, as illustrated in FIG. 4, when the described double layer photoreceptor is positively charged, the electron pairs do not travel through the polyvinyl carbazole layer, since the polyvinyl carbazole layer transports holes and not electrons. As a result, the charges are not neutralized and little, if any, differential in voltage is created at the surface as required for establishing a latent electrostatic image capable of good visual development.

It is an object of this invention to produce and to provide a method for producing a bi-modal photoreceptor capable of being positively charged for us in the standard copier mode or negatively charged for use as in the laser writing mode.

These and other objects and advantages of this invention will hereinafter appear and for purposes of illustration, but not of limitation, embodiments of the invention are shown in the accompanying drawings, in which.

BRIEF DESCRIPTION OF THE INVENTION

The photoreceptor embodying the features of this invention comprises multiple coatings on a conductive substrate, including a first photoconductive or charge generative layer, a top layer that transmits normal light such as white light of a first band width but is opaque or absorptive and charge generative to a second band width, such as red laser light and an intermediate layer which, like the polyvinyl carbazole layer of U.S. Pat. No. 4,026,703, is transparent to light of the first band width and is characterized by permitting transport of holes or charges and not electrons, to enable light of the first band width such as white tungsten light to reach the photoconductive layer.

DETAILED DESCRIPTION OF THE INVENTION

The substrate 30 is of the type conventionally used in the fabrication of a photoconductive receptor in that it comprises a conductive material, such as aluminum or other conductive material or a conductive layer of aluminum or the like conductive material on a suitable sheet support.

The photoconductive layer 32 is preferably a thin layer of vitreous selenium or other photoconductive material capable of photogenerating and injecting photo excited charge carriers, such as holes.

Layer 34 is an organic polyalkylene carbazole such as polyvinyl carbazole, layer or other layer which is essentially non-light sensitive in the visible ray region and is able to transport photogenerated charge carriers such as holes through to the top surface thereof when negatively charged while resisting transport of electron pairs.

The top layer 36 is formed of a material that is capable of transmission or is transparent to normal light but is opaque or absorptive to prevent transmission of red laser light. Representative of such materials that can be used as the top layer are dye or dyes having a narrow absorption band in the range of the laser or similar output from a device. Such dye or dyes are represented by the class of triphenyl methane dyes such as Solvent Green I, the class of anthraquinone dyes such as Acid Blue 81. The dye component can be used to sensitize a suitable polymer carrier such as a dye sensitized polyvinyl carbazole.

Figure 1:
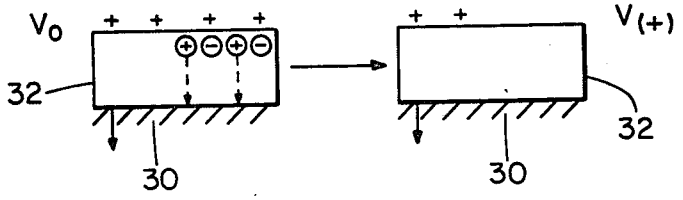
FIG. 1 is a schematic sectional view showing the charge phenomenon occurring with positive charge on a single layer photoreceptor.
Figure 2:
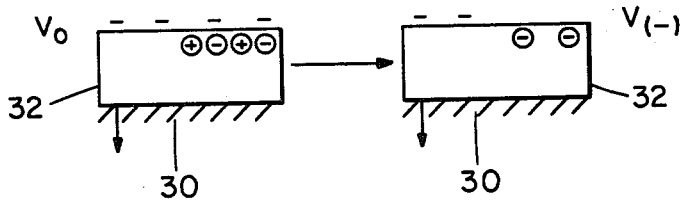
FIG. 2 is a sectional view similar to that of FIG. 1 showing the charge phenomenon occurring with a negative charge on the photoreceptor.
Figure 3:
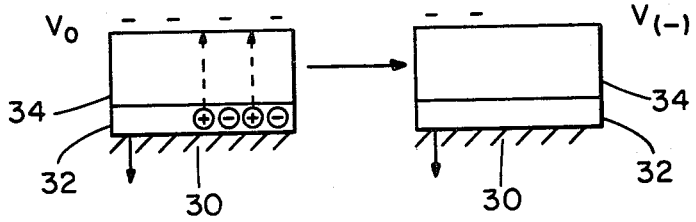
FIG. 3 is a schematic sectional view of the charge phenomenon occurring with a negative charge in a double layer photoreceptor.
Figure 4:
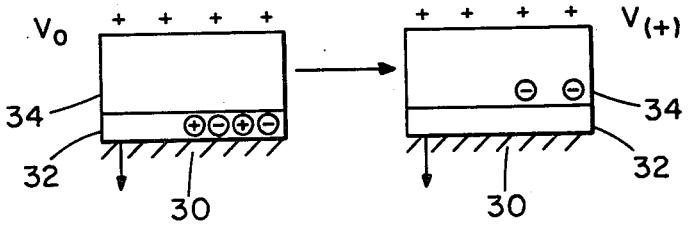
FIG. 4 is a sectional view similar to that of FIG. 3 showing the charge phenomenon occurring with a positive charge on the double layer photoreceptor.
Figure 5:
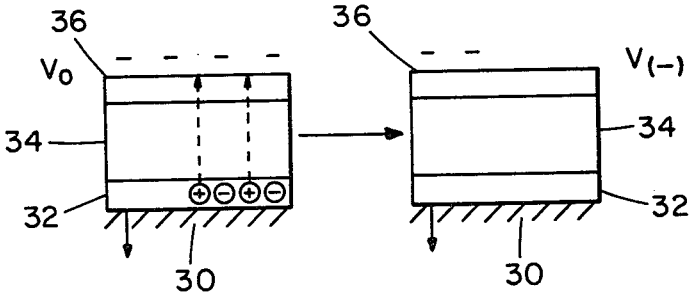
FIG. 5 is a schematic sectional view showing the charge phenomenon occurring with a negative charge on a photoreceptor embodying the features of this invention.
Figure 6:
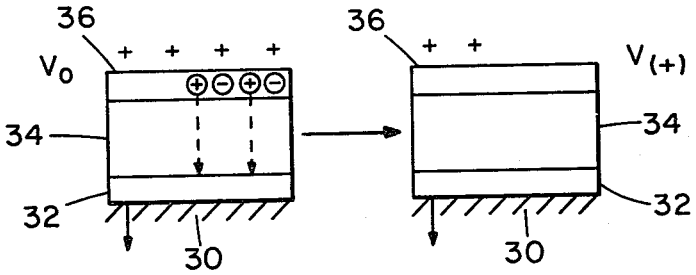
FIG. 6 is a sectional view similar to that of FIG. 5 showing the charge phenomenon occurring with a positive charge on the photoreceptor of this invention.

The phenomenon occurring in the operation of the photoreceptor, when negatively charged for use in a normal light mode, and when positively charged for use in a laser light copying mode, are depicted in FIGS. 5 and 6.

When, as depicted in FIG. 5, the tri-layer photoreceptor of this invention is used in a normal light copying mode with an overall negative charge on the surface, the top layer 36 and the intermediate layer 34 permit the light to penetrate to the photoconductive (Se) layer 32 covering the conductive substrate 30. The photons of the light energy create holes and electrons in the selenium as in the previously described normal copying mode. The holes travel through the intermediate layer 34 and through the top layer 36 to neutralize the negative charges at the surface. The electrons are so near the conductive substrate, at positive potential, that they are drawn to the conductive substrate and grounded. In this manner, a charge differential is established at the surface between the light struck areas and the non-light struck areas to produce a strong latent electrostatic image capable of visual development.

When, as depicted in FIG. 6, the tri-layer photoreceptor of this invention is provided with an overall positive charge, exposure is made with a red laser light selected to match the light responsive characteristic of the top layer 36. For example, use can be made of a red laser light which produces photons that create hole and electron pairs in the particular material of which the top layer 36 is made. Upon exposure, the electrons will discharge or neutralize the positive surface charges while the holes are injected through the interface between the top layer, through the intermediate layer 34, and the photoconductive selenium layer 32 to the conductive backing at ground potential. The result is a voltage differential at the surface between the light struck areas and the non-light struck areas sufficient to define an electrostatic image capable of good visual development.

Having described the basic concepts of the invention, illustration will not be made of the preparation of a photoreceptor representative of the practice of this invention.

EXAMPLE 1

Preparation of the photoconductive coating

Composition: 99.999% by weight selenium

The selenium is deposited onto an aluminum base sheet 30 to form a coating 32 having a thickness of about 51$\mu$. Vacuum deposition of vitreous selenium is made in the conventional manner from an evaporation vessel at about 300° C. under a vacuum of $1\times10^{-5}$ mmHg.

EXAMPLE 2

Preparation of intermediate coat 34

Composition: 10 ml. of 10% by weight solution of polyvinyl carbazole (Polysciences, Inc.) in tetrahydrofuran The composition is applied to the surface of the vitreous selenium layer 32 by a #32 wire wound rod at a coating weight of about 1–8 and preferably 3–6 lbs. per 3,000 sq. ft. This is followed by air drying for at least 3 hours at a temperature of about 50° C. or ambient temperature.

EXAMPLE 3

Preparation of top coat 36

Compositon:

10 ml. of 10% by weight solution of polyvinyl carbazole (Polysciences, Inc.) in tetrahydrofuran.

12 ml. of 0.5% by weight solution of C.I. (Color Index) Solvent Blue 36 Dyestuff (E. I. Dupont) in tetrahydrofuran;

0.25 gr. or about 10 drops of dioctyl phthalate.

The coating composition is wire coated onto the surface of the coating 34 with a rod wound with a #32 wire to provide a coating weight of about 1–8 lbs. and preferably 3–6 lbs. per 3,000 sq. ft. and then is air dried overnight or for 3 hours at a temperature of about 50° C.

Figure 7:
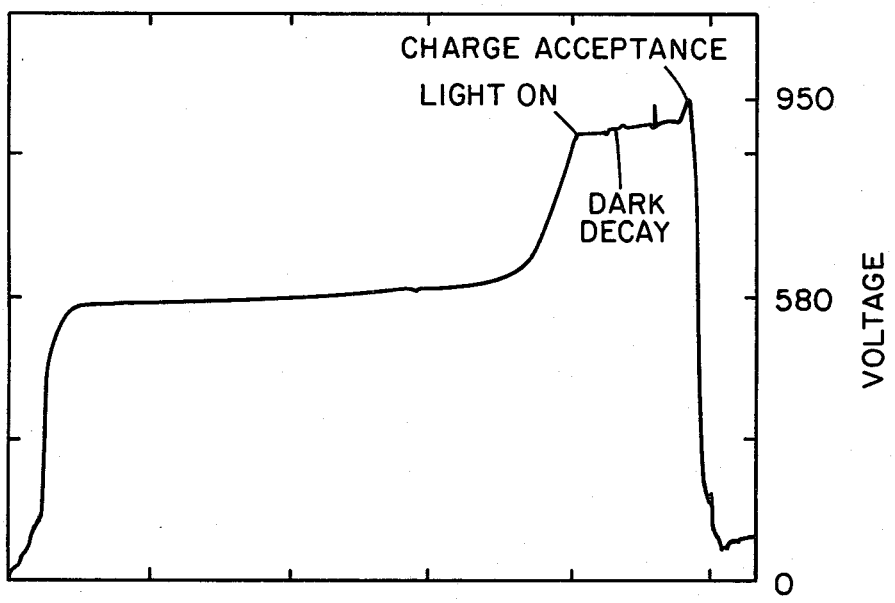
FIG. 7 is a curve showing voltage on the photoreceptor with white light exposure after negative corona charge.
Figure 8:
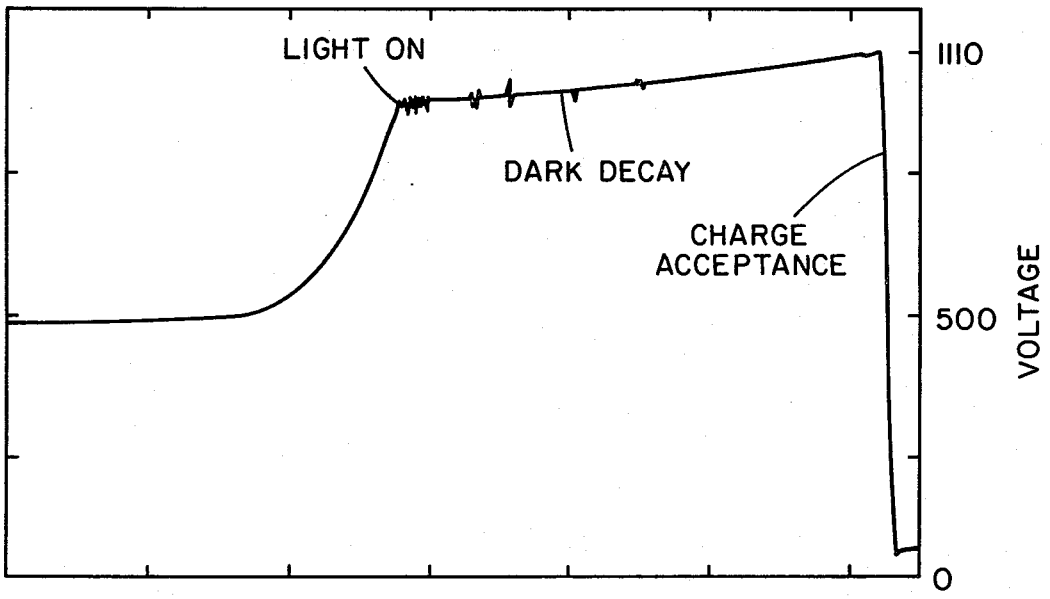
FIG. 8 is a curve showing voltage on the photoreceptor with laser light exposure after positive corona charge.

FIGS. 7 and 8 show the results of electro-optical tests performed on the photoreceptor prepared by examples 1, 2 and 3. In FIG. 7, the photoreceptor was charged with a negative corona to a voltage of 950 volts. Slight decay occurred until exposure to white light which caused the voltage to decay rapidly in the exposed area to about 580 volts.

FIG. 8 shows results of the electro-optical tests on the same photoreceptor on which the photoreceptor was initially charged with positive corona to 1100 volts and allowed to dark decay to about the 950 volt level of the full form exposure mode of FIG. 7. Exposure to laser light caused rapid decay in the exposed areas to slightly less than 500 volts.

Thus the photoreceptor of examples 1, 2 and 3 is acceptable for use in producing images by full form exposure with white light and in the red light exposure with laser light.

As previously pointed out other conductive substrates can be used instead of aluminum. For example, use can be made in example 1 of other conductive materials to which adherent layers of vitreous selenium can be deposited, such as copper, zinc, iron, as well as conductive organic coatings or treated paper.

It will be understood that changes may be made in the details of construction, arrangement and operation without departing from the spirit of the invention, especially as defined in the following claims.

I claim:

1. A bi-modal photoreceptor comprising a conductive backing, a first charge generative layer on said backing capable of photogenerating and injecting photo excited charge carriers, a top second charge generative layer formed of a composition containing a polyalkyl carbazole and a sensitizing dyestuff which is characterized by transparency to light of a first band width and is absorptive to a second band width, and an intermediate layer capable of transporting photogenerated charge carriers which is characterized by transparency to the first band width.

2. A photoreceptor as claimed in claim 1 in which the conductive backing is a conductive metal layer.

3. A photoreceptor as claimed in claim 1 in which the first generative layer is formed of vitreous selenium.

4. A photoreceptor as claimed in claim 1 in which the intermediate layer is formed of a polyalkylene carbazole.

5. A photoreceptor as claimed in claim 4 in which the intermediate layer is formed of a polyvinyl carbazole.

6. A photoreceptor as claimed in claim 1 in which the light of a first band width is white light.

7. A photoreceptor as claimed in claim 1 in which the light of the second band width is red laser light.

8. In the method of producing copy by electrophotography comprising charging the surface of the photoreceptor of claim 1 with one polarity of corona charge in which the first charge generative layer generates hole-electron pairs when exposed to light of the first or second band width and in which the top second charge generative layer generates hole-electron pairs in the areas exposed to light of the second band width and in which the intermediate layer transports holes or electrons more rapidly than the other, whereby when the intermediate layer transports holes more rapidly than electrons and the surface is negatively charged and the photoreceptor is exposed to a light pattern of the first band width, the light penetrates the top and intermediate layers to the first charge generative layer to form hole-electron pairs in the exposed areas, in which the holes transport through the intermediate layer to the top layer to discharge negative charges in the exposed areas while leaving negative charges in the non-exposed areas for image development, and when the surface is positively charged and the photoreceptor is exposed to light patterns of the second band width, the light is absorbed by the top second charge generative layer to form hole-electron pairs whereby the holes transport through the intermediate layer while the electrons discharge the positive charges in the exposed areas, leaving positive charges in the unexposed areas for image development, and developing said image.

* * * * *